United States Patent [19]

Martin

[11] 4,379,212

[45] Apr. 5, 1983

[54] ELECTRO-ACOUSTIC TRANSDUCER

[75] Inventor: Erwin Martin, Munich, Fed. Rep. of Germany

[73] Assignee: Siemens Aktiengesellschaft, Berlin & Munich, Fed. Rep. of Germany

[21] Appl. No.: 237,692

[22] Filed: Feb. 24, 1981

[30] Foreign Application Priority Data

Feb. 29, 1980 [DE] Fed. Rep. of Germany ..... 3007834

[51] Int. Cl.[3] ..... H04R 15/00

[52] U.S. Cl. ..... 179/110 A; 179/180; 310/322; 181/151; 181/160

[58] Field of Search ..... 179/110 A, 180, 178, 179/179; 310/322, 324, 326, 327; 181/157, 160, 182, 151, 292

[56] References Cited

U.S. PATENT DOCUMENTS 2,252,846 8/1941 Giannini et al. ..... 181/160 X 4,292,561 9/1981 Martin ..... 310/322

FOREIGN PATENT DOCUMENTS 2322475 11/1974 Fed. Rep. of Germany .

*Primary Examiner*—Benjamin R. Fuller

*Attorney, Agent, or Firm*—Hill, Van Santen, Steadman, Chiara & Simpson

[57] ABSTRACT

An electrical acoustical transducer is provided having a piezoelectrical layer in a housing with a transducer plate. The transducer plate divides the housing into a front chamber and a rear chamber. In the rear chamber, there is provided a Helmholtz resonator for the attenuation of resonance increases. With the invention a Helmholtz resonator is designed such that its acoustical characteristics do not change through environmental influences. Instead of covering the resonator by means of a customary silk disk, several narrow slots are arranged in the carrier plate.

7 Claims, 5 Drawing Figures

ELECTRO-ACOUSTIC TRANSDUCER

BACKGROUND OF THE INVENTION

The invention relates to an electro-acoustic transducer comprising a transducer plate which is arranged in a housing and by which the space within the housing is divided into a front chamber and a rear chamber. A fitting which closes off the front chamber is also provided together with at least one Helmholtz resonator arranged in the rear chamber and which serves to attenuate rises in resonance.

In electro-acoustic transducers used in telephone technology, the rise in resonance caused by the mass and the springiness of the diaphragm is compensated in a known manner by means of a Helmholtz absorption resonator attached to the rear chamber of the diaphragm. For this purpose the mass, springiness and friction of the air are established by geometrically constructing the Helmholtz resonator in the form of a collar to which an attenuating material such as silk, wire latticework, or sintered metal is subsequently applied. The flow resistance of the attenuating material is however subject to relatively high tolerances which are further increased by the application of the attenuating material to the collar, for example as a result of an adhesive process, as a result of which disadvantageous deviations can occur in high volume production. A further disadvantage consists in the relatively high costs for materials, assembly and checking.

In another known structure (German OS No. 2 322 475, incorporated herein by reference), the mass and friction of the air is compensated in annular gaps which possess a width of approximately 100 to 150 μm and which are relatively long (a few mm), and which are formed by two synthetic die cast components which project into one another. Here cylindrical pins of a transducer housing project into holes distributed uniformly over the periphery of a partition wall, where the pins possess a somewhat smaller diameter than the holes. The disadvantage of such a solution consists in the very high degree of accuracy demanded for the two die-cast components.

SUMMARY OF THE INVENTION

An object of the present invention is to provide a design of a Helmholtz resonator wherein the above described disadvantages are avoided.

This object is realized in accordance with the invention in that the Helmholtz resonator consists of two zones, one of which is formed by narrow sound openings arranged in a carrier plate and the other of which is formed in known manner by the collar of the Helmholtz resonator.

The advantage in comparison to the known constructions is that the requisite sound openings can be die-cast during the manufacturing process, thereby avoiding an additional operation. As only one component is used the very high accuracy required of the two die-cast components in accordance with German OS No. 2 322 475 is unneeded.

A further advantage consists in that resonators of this kind produced in accordance with the invention can be produced at any time in an existing extrusion die and are not subject to possible alterations during assembly.

It can be advantageous to form the sound openings by means of slots in the carrier plate.

It is particularly expedient to form the sound openings by annular gaps as this substantially simplifies the production process.

An expedient embodiment consists in that slots possess a length of 0.25 to 0.5 mm, a width of 0.05 to 0.1 mm, and a depth of 2 to 3 mm, where the resonator collar possesses a diameter of approximately 2.4 mm and a length of approximately 3.4 mm.

If the sound openings are formed as annular gaps, it is expedient for the sum of the depths to amount to approximately 8 mm and a width of 0.05 to 0.1 mm, where the resonator collar possesses a diameter of approximately 2.4 mm and a length of approximately 3.4 mm.

DESCRIPTION OF THE PREFERRED EMBODIMENTS

Figure 1:
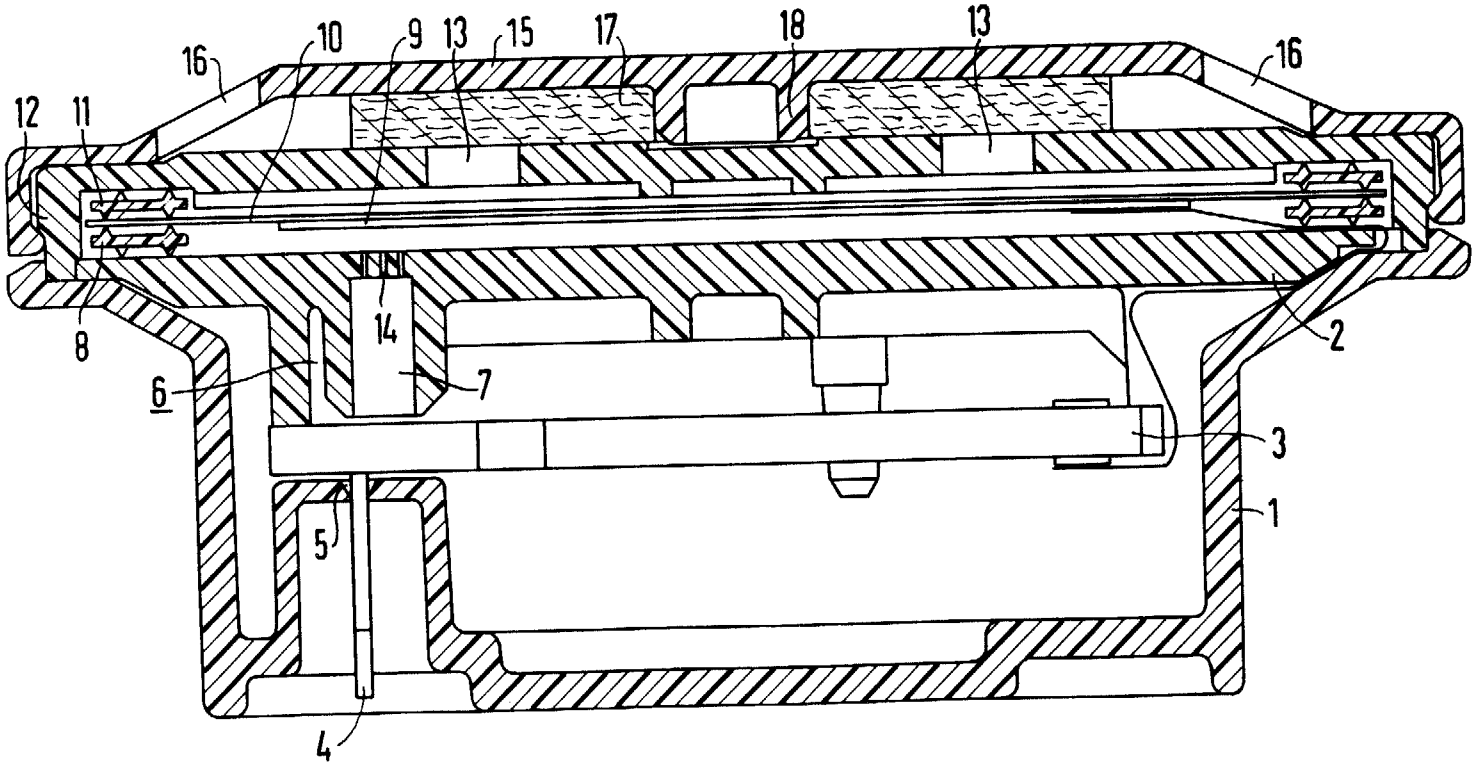
FIG. 1 illustrates a cross-section through an electro-acoustic transducer in accordance with the invention.

The following components are consecutively in a housing 1. First is the carrier 2 which, on its side facing towards the base of the housing 1, bears a circuit board 3 provided with electronic components. On this circuit board there are arranged two knife switch or contact prongs (knife switch prong 4 has been shown) which project through recesses 5 of the housing, which form the external electrical terminal, and which fix the carrier 2 together with the circuit board 3 in the housing.

Also arranged on the carrier 2 is a bearing body 8 above which there is mounted a transducer plate 10 provided with a piezoceramic coating 9. A further bearing body 11 forms the counter bearing. The housing 1 is sealed by a baffle plate 12 which is indivisibly connected to the housing. This baffle plate is provided with a plurality of sound openings 13 arranged in the form of a circle.

The transducer formed in this way is closed off by a fitting 15 which again possesses sound openings 16 arranged in a circle. These sound openings are arranged in a circle having a larger diameter than the sound openings arranged in the baffle plate. Between the baffle plate and the fitting there is arranged an attenuating plate 17 which is mounted by a cylindrical attachment 18 of the fitting and which partially fills the space in front of the baffle plate. Here the attenuating plate is designed in such manner that it covers the sound openings of the baffle plate.

In accordance with the invention the carrier 2 possesses a plurality of Helmholtz resonators 6, although only one of these has been illustrated. The Helmholtz resonator consists of the collar 7 and a plurality of slots 14 by which the latter is closed off.

Figure 2:
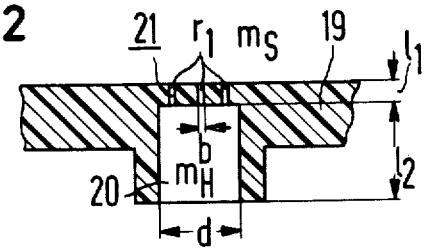
FIG. 2 illustrates a Helmholtz resonator in accordance with the invention.

FIG. 2 is a detailed view of a Helmholtz resonator. This consists of a housing 19 which possesses a cylindrical recess which accommodates the resonator neck or collar 20 of mass $m_H$, length $l_z$ and diameter d. On one side the resonator neck or collar 20 has a closed end with slots 21 therein which possess the friction $r_1$ and the air mass $m_s$. The length of the slots has been referenced $l_1$.

Figure 3:
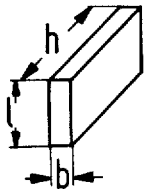
FIG. 3 illustrates a slot in the Helmholtz resonator.

A slot is illustrated in FIG. 3 in order that its dimensions may be clearly seen. The slot possesses a length $l_1$, a depth h, and a width b.

Figure 4:
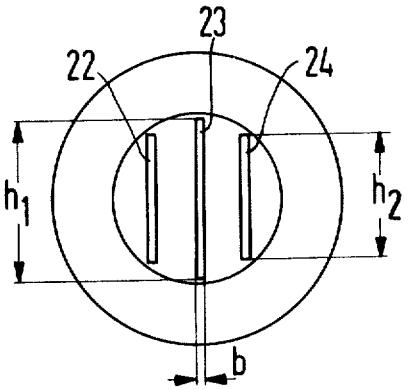
FIGS. 4 and 5 illustrate a Helmholtz resonator in a plan view from below.
Figure 5:
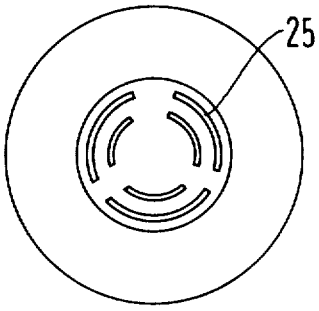

FIG. 4 illustrates a Helmholtz resonator viewed from the collar. It possesses three slots 22, 23, 24 for each resonator collar, and the overall depth $h=2\ h_2+h_1$ amounts to approximately 8 mm. In FIG. 5 the sound openings are in the form of annular gaps 25 and the overall depth again amounts to approximately 8 mm.

Although various minor modifications may be suggested by those versed in the art, it should be understood that I wish to embody within the scope of the patent warranted hereon all such modifications as reasonably and properly come within the scope of my contribution to the art.

I claim as my invention:

1. An electro-acoustic transducer, comprising:

a transducer plate arranged in a housing and by which a space in the housing is divided into a front chamber and a rear chamber;

a fitting which closes off the front chamber;

at least one Helmholtz absorption resonator means arranged in conjunction with a plate in the rear chamber for attenuating rises in resonance;

the Helmholtz resonator means comprising a cylindrical collar zone having one end closed off except for narrow slot-like sound openings arranged in said plate and the other end of the collar being substantially completely open; and the slot-like openings being die cast in the plate and the specific dimensions being chosen to establish a desired air friction resistance of the Helmholtz resonator means to achieve a desired attenuation response.

2. A transducer according to claim 1 wherein the plate comprises a carrier plate above which the transducer plate is supported.

3. A transducer according to claim 1 wherein said narrow slot-like sound openings are formed by parallel slots in the carrier plate.

4. A transducer according to claim 1 wherein the slot-like sound openings are formed by annular gaps in the plate.

5. A transducer according to claim 3 wherein the slots possess a range of length of 0.25 to 0.5 mm, a range of width of 0.05 to 0.1 mm, and a range of depth of 2 to 3 mm, and where the resonator collar possesses a diameter of approximately 2.4 mm and a length of approximately 3.4 mm.

6. A transducer according to claim 4, wherein a sum of the depths of the annular gaps amounts to approximately 8 mm, and they have a width of 0.05 to 0.1 mm, and the resonator collar possesses a diameter of approximately 2.4 mm and a length of approximately 3.4 mm.

7. A method for producing an electro-acoustic transducer, comprising the steps of:

providing a transducer plate arranged in a housing and by which a space in the housing is divided into a front chamber and a rear chamber;

providing a cover which closes off the front chamber;

providing a carrier plate in the rear chamber above which the transducer plate is supported;

providing at least one Helmholtz absorption resonator means provided in the rear chamber for attenuating rises in resonance, said Helmholtz resonator means being formed by a plurality of slot-like openings in said carrier plate and a collar projecting rearwardly of the carrier plate with an end of the collar below the slots substantially completely open; and selecting a desired air friction resistance of the Helmholtz chamber by die-casting the slot-like openings in the carrier plate so as to set desired specific dimensions to achieve a desired attenuation response of the Helmholtz chamber.

* * * * *